US011717948B2

(12) United States Patent
Letson

(10) Patent No.: US 11,717,948 B2
(45) Date of Patent: Aug. 8, 2023

(54) ELECTRONIC SHELF LABEL REMOVAL TOOL

(71) Applicant: Walmart Apollo, LLC, Bentonville, AR (US)

(72) Inventor: Eric Letson, Bentonville, AR (US)

(73) Assignee: Walmart Apollo, LLC, Bentonville, AR (US)

( * ) Notice: Subject to any disclaimer, the term of this patent is extended or adjusted under 35 U.S.C. 154(b) by 148 days.

(21) Appl. No.: 17/187,073

(22) Filed: Feb. 26, 2021

(65) Prior Publication Data

US 2021/0268633 A1 Sep. 2, 2021

Related U.S. Application Data

(60) Provisional application No. 62/983,063, filed on Feb. 28, 2020.

(51) Int. Cl.

| | |
|---|---|
| ***B25B 27/14*** | (2006.01) |
| ***G09F 3/20*** | (2006.01) |
| ***B25G 1/10*** | (2006.01) |

(52) U.S. Cl.

CPC ..... *B25B 27/14* (2013.01); *B25G 1/102* (2013.01); *G09F 3/204* (2013.01); *G09F 3/208* (2013.01)

(58) Field of Classification Search

CPC ..... B25B 27/00; B25B 27/14; B25B 27/146; B25B 31/00; B65G 7/02; B65G 7/08; B66F 15/00; B44D 3/162; B44D 3/164; B25C 11/00; E04G 23/08; E04G 2023/085; G09F 3/18; G09F 3/204; G09F 3/208

USPC ..... 29/426.5, 278; 81/177.1; D8/88; 7/166

See application file for complete search history.

(56) References Cited

U.S. PATENT DOCUMENTS

| | | | | |
|---|---|---|---|---|
| 2,524,475 A * | 10/1950 | Renz | B44D 3/06 15/236.08 |
| 4,336,706 A * | 6/1982 | Garcia | B44C 5/08 81/485 |
| 5,402,897 A | 4/1995 | Garfinkle | |
| 6,622,410 B2 | 9/2003 | Wilkes et al. | |
| 2006/0151601 A1 | 7/2006 | Rosenfeld | |

(Continued)

FOREIGN PATENT DOCUMENTS

| | | | |
|---|---|---|---|
| CA | 2266754 C * | 8/2008 | A63C 11/222 |
| WO | 2004079698 A1 | 9/2004 | |

OTHER PUBLICATIONS

Unknown, "Label Strip & Fastener Tool, Gondola Shelf UPC Channel, Ticket Pry Scraper Remover", Store Fixtures Direct, 2019, pp. 1-4.

*Primary Examiner* — Lee D Wilson
*Assistant Examiner* — Alberto Saenz
(74) *Attorney, Agent, or Firm* — Barta, Jones & Foley, PLLC

(57) ABSTRACT

Examples provide an electronic shelf label (ESL) removal tool for removing an electronic shelf label from a shelf. The tool includes a central body member which is substantially cylindrical. A gripping member is included at a first end of the central body enabling a user to grip the tool. An expansion member at a second end of the central body slides between a shelf rail to expand or increase a distance between the rails. The tool enables the user to remove the ESL from between the rails more easily. A wedge-shaped tab at the second end of the central body fits between one edge of the shelf rail and the edge of the ESL to pry the ESL out from between the rails.

16 Claims, 13 Drawing Sheets

(56) References Cited

U.S. PATENT DOCUMENTS

| | | | | |
|---|---|---|---|---|
| 2010/0095737 | A1* | 4/2010 | Persson | B25G 1/00 16/421 |
| 2012/0098282 | A1* | 4/2012 | Langan | B25G 3/30 7/167 |
| 2018/0243890 | A1* | 8/2018 | Hudlin | B25B 27/0092 |

* cited by examiner

ELECTRONIC SHELF LABEL REMOVAL TOOL

BACKGROUND

An electronic shelf label (ESL) is a digital signage device providing product information on retail shelving, such as, but not limited to, product name, product pricing, product sizing, barcode, and/or any other type of information. An ESL may also be referred to an electronic labeling device or eLabel. An ESL is typically attached to an edge of a shelf via a rail or bracketing such that it is visible to users browsing products sitting on the shelf. Some types of ESLs can be removed by sliding it off the end of the rail. However, if the rail is very long, placed in a difficult to reach location or area with limited maneuverability, and/or the rails are inflexible, it may be difficult or impossible to remove the ESL by sliding it off the railing. In other solutions, a user can manually pull the ESL out of the shelf rail or bracketing using their fingers or screwdriver. Pulling or prying the ESL off the shelf rail in this manner can damage the shelf, bend, or distort the shelf railing and/or result in injury to the user's fingers. Moreover, this type of ESL removal can be slow, time-consuming, and unreliable.

SUMMARY

Some examples provide an ESL removal tool. The tool includes a central body member which is substantially cylindrical; a gripping member at a first end of the central body enabling a user to grip the tool; a substantially oval expansion member at a second end of the central body for sliding between a parallel set of shelf rails configured to increase a distance between the parallel set of shelf rails; and a wedge member at the second end of the central body configured to fit between one edge of a shelf rail and a portion of the ESL to facilitate release the ESL from between the set of parallel rails.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

Corresponding reference characters indicate corresponding parts throughout the drawings.

DETAILED DESCRIPTION

A more detailed understanding can be obtained from the following description, presented by way of example, in conjunction with the accompanying drawings. The entities, connections, arrangements, and the like that are depicted in, and in connection with the various figures, are presented by way of example and not by way of limitation. As such, any and all statements or other indications as to what a particular figure depicts, what a particular element or entity in a particular figure is or has, and any and all similar statements, that can in isolation and out of context be read as absolute and therefore limiting, can only properly be read as being constructively preceded by a clause such as "In at least some examples, . . . " For brevity and clarity of presentation, this implied leading clause is not repeated ad nauseum.

Referring to the figures, examples of the disclosure provide an electronic shelf label (ESL) removal tool for safely and easily removing ESLs from retail shelving. In some examples, the ESL removal tool includes an expansion member for increasing the distance (gap or spacing) between shelf rails securing an ESL inside a shelf channel. The expansion member pushes the rails farther apart to permit easy and smooth removal of the ESL without damaging the ESL or the rails.

In other examples, the ESL removal tool includes a wedge member for prying an ESL out of a shelf channel. The wedge member includes a tapered edge that fits inside the gap between the underside edge of the ESL and the edge of one of the rails securing the ESL inside the shelf channel. As the tool is leveraged up or down, the ESL is popped or pried out of the rails and freed from the shelf channel.

Figure 1:
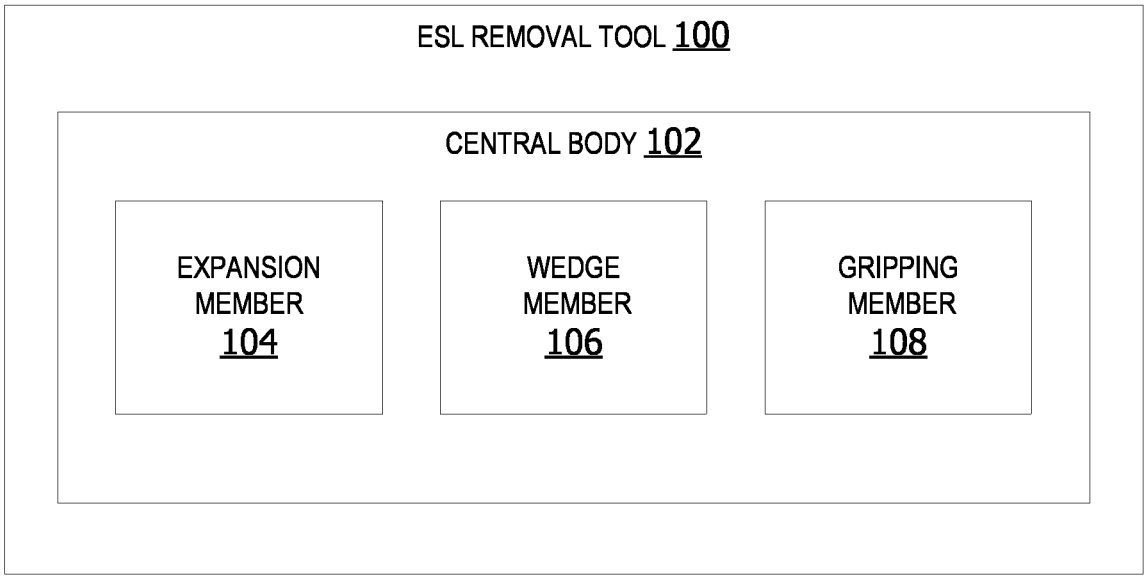
FIG. 1 is an exemplary block diagram illustrating an electronic shelf label (ESL) removal tool.

Referring now to FIG. 1, an exemplary block diagram illustrating an electronic shelf label (ESL) removal tool 100 is shown. The ESL removal tool 100 includes a central body 102. In some examples, the central body 102 has a substantially cylindrical shape. However, the ESL removal tool 100 is not limited to a cylindrical shape. In other examples, the central body may optionally have an oval shape, a rectangular shape, a spherical shape, or any other suitable shape.

In some examples, the ESL removal tool 100 includes an expansion member 104. The expansion member 104 attached to the central body 102 is configured to fit between a set of rails or between a set of brackets on an edge of a shelf holding or otherwise securing one or more ESLs to the edge of the shelf visible to users looking at the shelf. The expansion member 104 in some examples has a substantially oval or ovoid shape. However, the examples are not limited to an oval or ovoid shape. In other examples, the expansion member 104 may have a substantially rectangular shape or any other suitable shape configured to fit between a set of rails when the ESL removal tool 100 is oriented in a latitudinal or sideways orientation. When the expansion member 104 is positioned between the set of rails or set of brackets securing the ESL, the user holding the ESL removal tool 100 turns the tool into a longitudinal or up-and-down orientation to expand or otherwise push the rails farther apart. This action increases the distance between the rails or brackets, enabling the ESL to be removed from the shelf channel associated with the rails or brackets.

In other examples, the ESL removal tool 100 includes a wedge member 106. The wedge member 106 is a tab or wedge having a thick end irremovably attached to the central body 102 and a tapering end. The thin edge at the tapering end of the wedge member 106 is inserted or otherwise slides of fits between the outer edge of one rail securing an ESL into the shelf channel and the underside or back of a portion of the ESL. While the wedge member 106 is fitted between the narrow space between the ESL and the rail, the user can push the tool downward or raise the tool upward to pop or pull the ESL out from under the edge of the rail. This frees the ESL from the set of rails securing the ESL to the shelf edge.

In some examples, the wedge member 106 is a substantially triangular shaped wedge protruding from one end of the central body 102. However, the examples are not limited to a triangular-shaped wedge. In other examples, the wedge member 106 may be a rectangular-shaped, cube-shaped, or any other shaped wedge having a tapering end configured to fit between the ESL and one of the rails or brackets securing the ESL to the edge of the shelf.

The ESL removal tool 100 in still other examples includes a gripping member 108. The gripping member 108 is a portion of the ESL removal tool configured for gripping by a user's hand and/or one or more of a user's fingers. The gripping member 108 in this example is a handle attached to one end of the central body 102. In other examples, the gripping member is implemented as a set of contoured ridges configured to fit one or more of a user's fingers. The contoured ridges may be set within the central body or on a separate handle member attached to the central body 102. In other examples, the gripping member includes a rubberized covering or padding to improve comfort during use and/or to reduce slippage.

Figure 2:
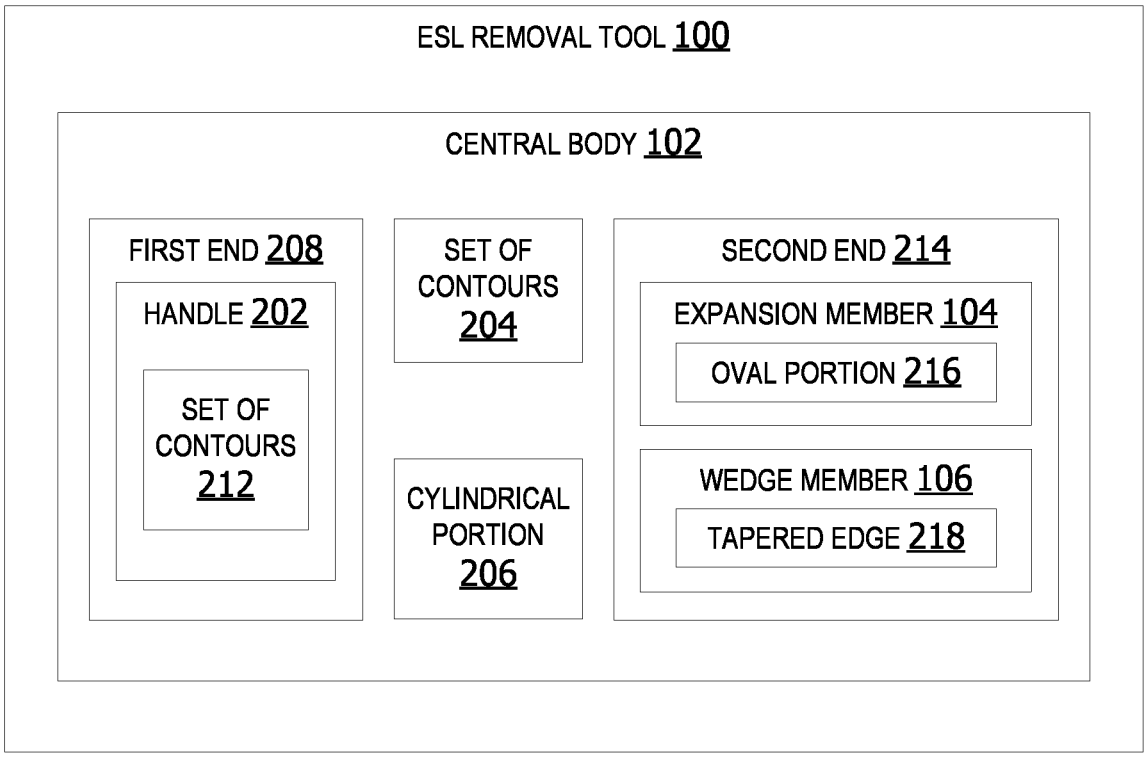
FIG. 2 is an exemplary block diagram illustrating an ESL removal tool including a handle.

FIG. 2 is an exemplary block diagram illustrating an ESL removal tool 100 including a handle 202. The handle 202 is optionally attached to a first end 208 of the central body 102. The central body 102 in some examples optionally includes a set of one or more contours 204 configured to conform to the fingers of a user gripping the ESL removal tool 100. The set of contours 204 may be positioned on one or more sides of the central body 102.

In some examples, the central body 102 includes a substantially cylindrical portion 206. In these examples, the set of contours 204 may be situated on a single face, side, or area of the cylindrical portion 206 of the central body 102. In other examples, the set of contours 204 includes two or more groups of contours on opposing sides of the central body 102. The set of contours may include a single contour for a single finger or thumb, as well as two or more contours to accommodate the fingers on one or more hands of the user. A contour in the set of contours 204 can include a ridge, a dip, outline, curve, or other contour configured to substantially conform to a finger or thumb of a user.

The handle 202 of the central body 102 in some examples is a "T" shaped handle. In other examples, the handle 202 is an "L" shaped handle. In still other examples, the handle 202 may be implemented as an oval shaped handle, a round handle, a cylindrical handle, or any other type of handle. The handle 202 optionally includes a set of contours 212 to conform to the fingers of the tool user.

The expansion member 104 and the wedge member 106 in this example are attached to or otherwise located on the second end 214 of the central body opposite the handle 202. In other examples, the wedge member 106 can be located at the first end 208 of the central body 102 and the expansion member 104 can be located at the second end 214 of the central body 102. In these examples, the ESL removal tool 100 may not include the handle. In other words, the wedge member 106 can be located at the first end instead of the handle.

The expansion member 104 in this example includes an oval portion 216 for expanding or separating rails on a shelf securing an ESL. The expansion member 104 is placed into the channel between the set of rails such that the oval portion 216 is between the rails and beneath the rail edges. The tool is turned by the user a quarter turn in either direction a quarter turn (clockwise or counterclockwise). As the tool turns, the oval portion 216 is rotated such that it is oriented lengthwise or perpendicular to the rails such that the ends of the expansion member press against the rails and push them farther apart. As the distance between the rails is increased by the expansion member 104, the ESL can be removed.

The wedge member 106 in this example includes a tapered edge 218. The tapered edge 218 fits between an edge of a rail and an edge of the ESL. The user moves the tool up or down to pull or push the edge of the ESL out and away from the lip of the rail. This frees the ESL for removal from the shelf channel.

Figure 3:
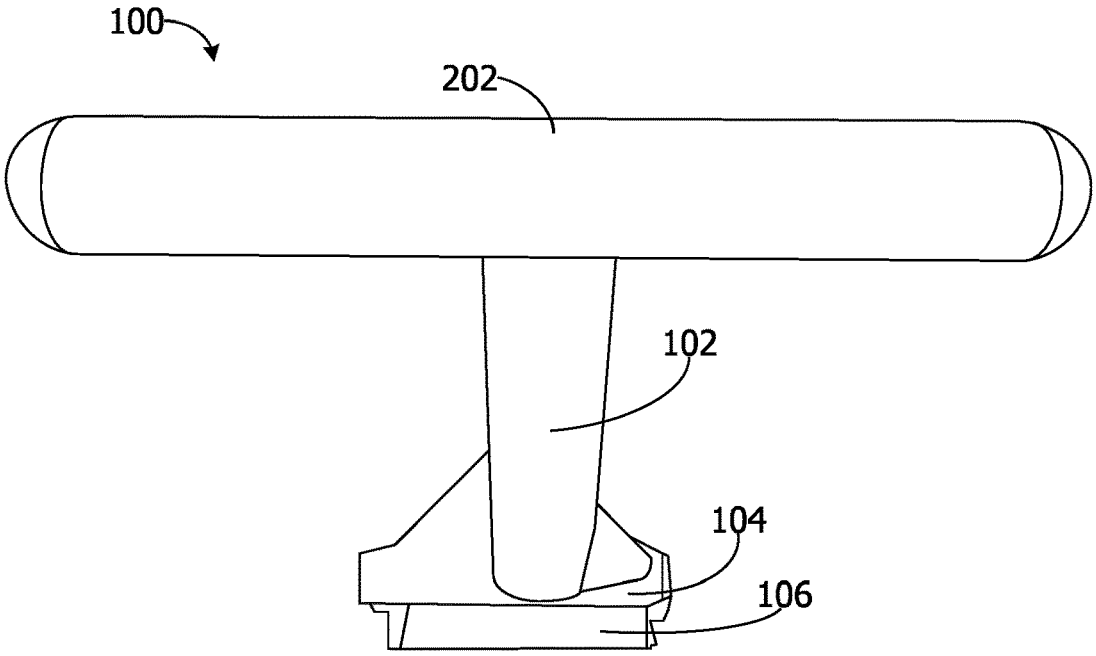
FIG. 3 is an exemplary block diagram illustrating a front view of an ESL removal tool.

FIG. 3 is an exemplary block diagram illustrating a front view of an ESL removal tool 100. The ESL removal tool 100 in this example includes a central body 102 having an expansion member 104 and a wedge member 106. The central body 102 optionally includes a handle 202.

Figure 4:
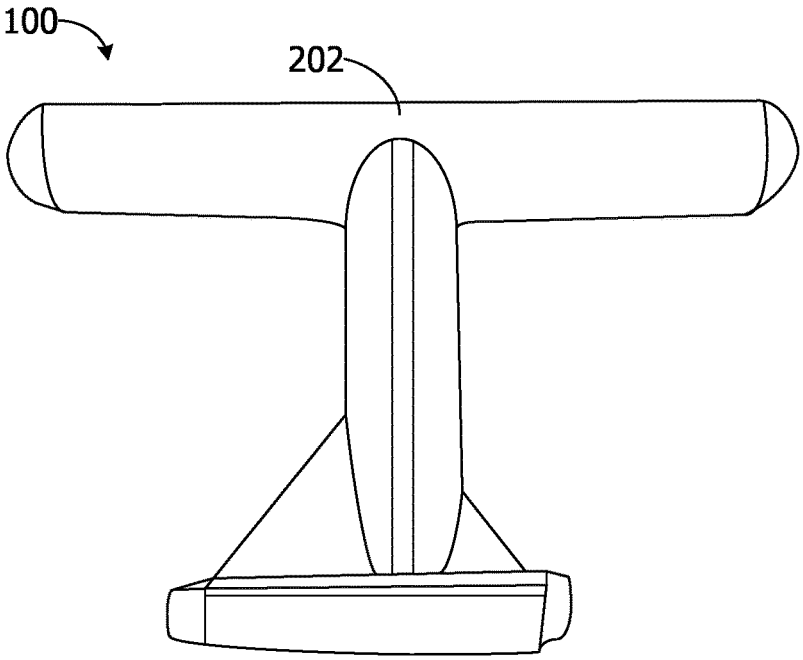
FIG. 4 is an exemplary block diagram illustrating a front view of an ESL removal tool including a "T" shaped handle.

FIG. 4 is an exemplary block diagram illustrating a front view of an ESL removal tool 100 including a "T" shaped handle 202. The handle 202 in this example is a "T" shaped handle. In other examples, the handle 202 can be implemented as an "L" shape, a "D" shape, a "C" or half-circle shaped handle, or any other type of handle.

Figure 5:
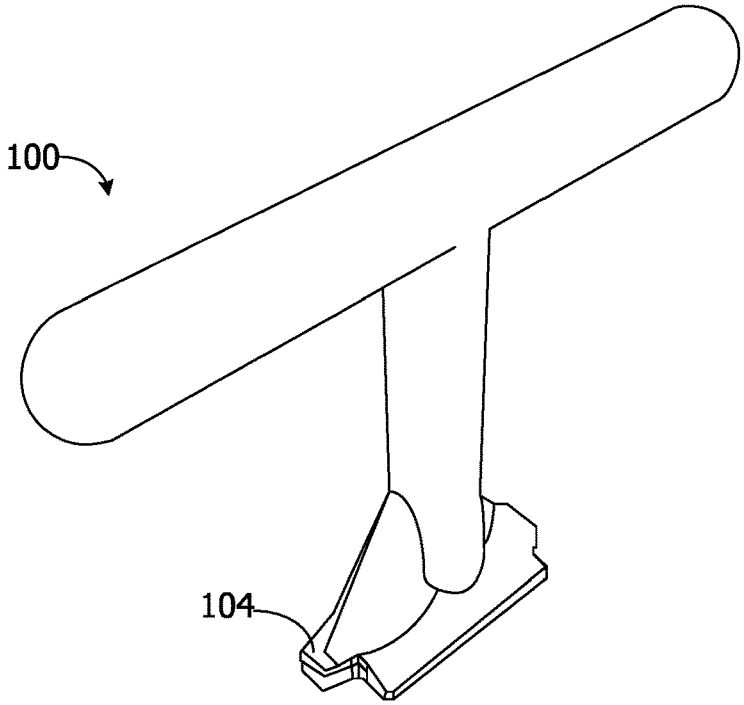
FIG. 5 is an exemplary block diagram illustrating an angled left side view of the ESL removal tool.

FIG. 5 is an exemplary block diagram illustrating an angled left side view of the ESL removal tool 100. The expansion member 104 in this example is a substantially oval or ovoid shape. In other examples, the expansion member 104 can be rectangular, round/circular, triangular, or any other suitable shape for pushing shelf rails apart.

Figure 6:
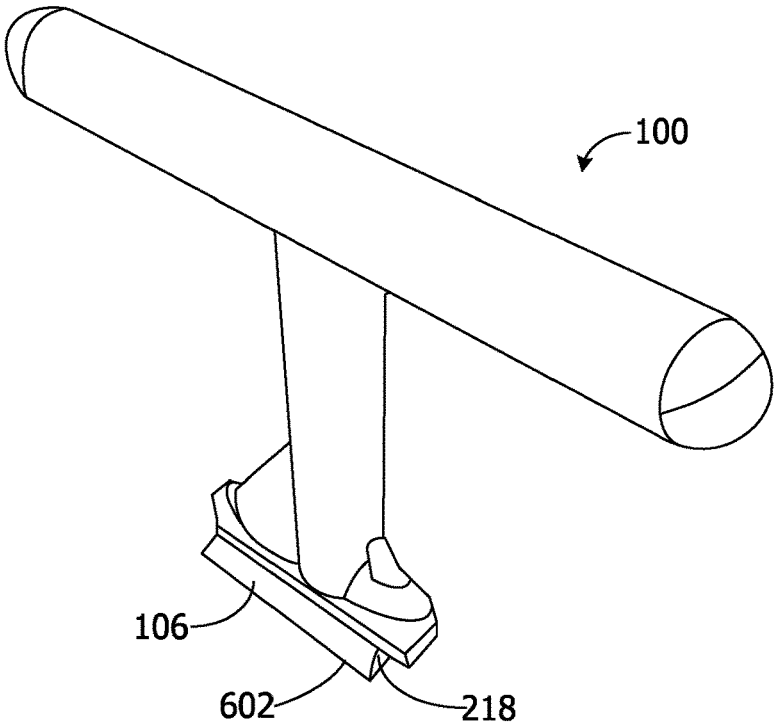
FIG. 6 is an exemplary block diagram illustrating an angled right-side view of the ESL removal tool.

FIG. 6 is an exemplary block diagram illustrating an angled right-side view of the ESL removal tool 100. The wedge member 106 in this non-limiting example is a substantially triangular-shaped wedge having a tapering edge 218. The thinnest end 602 of the tapering edge 218 is wedged between an ESL and a rail on a shelf channel to pry the ESL out of the shelf channel for removal.

Figure 7:
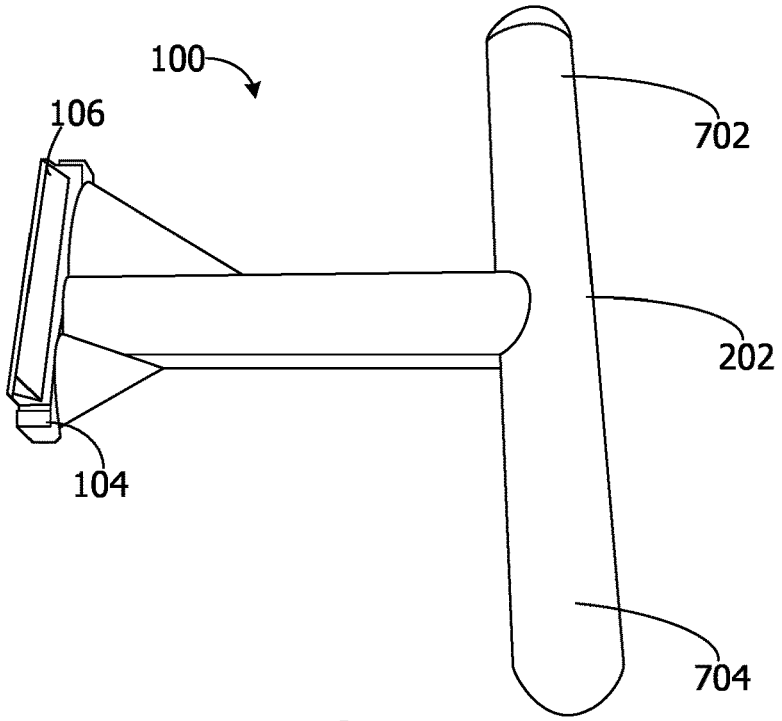
FIG. 7 is an exemplary block diagram illustrating an ESL removal tool laying on a table.

FIG. 7 is an exemplary block diagram illustrating an ESL removal tool 100 laying on a table. The ESL removal tool in this example includes an expansion member 104, a wedge member 106 and a handle 202. The handle 202 in this non-limiting example is a "T" shaped handle including a first part 702 of the handle 202 and a second part 704 of the handle 202. A user may grip the handle 202 with one hand while wrapping one or more fingers around the first part 702 of the handle and/or one or more fingers around the second part 704. In other examples, if the user requires more leverage, the user can place a portion of one hand on the first part 702 of the handle and a portion of the second hand on the second part 704 of the handle 202.

Figure 8:
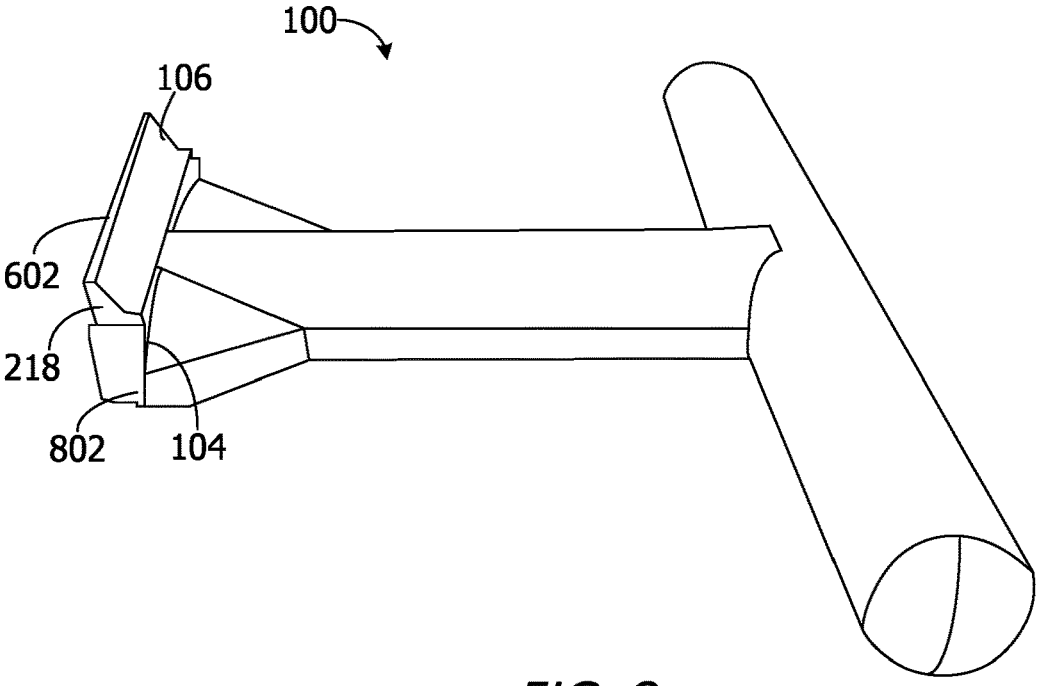
FIG. 8 is an exemplary block diagram illustrating another side view of the ESL removal tool.

FIG. 8 is an exemplary block diagram illustrating another side view of the ESL removal tool 100. In this example, the expansion member 104 includes a side edge 802 that can be wedged under a lip on a rail to push the rails in a set of two rails farther apart. The wedge member 106 includes a tapering edge 218. The thinnest end 602 wedges between an ESL and a rail to separate the ESL out from beneath the lip of the rail in other non-limiting examples.

Figure 9:
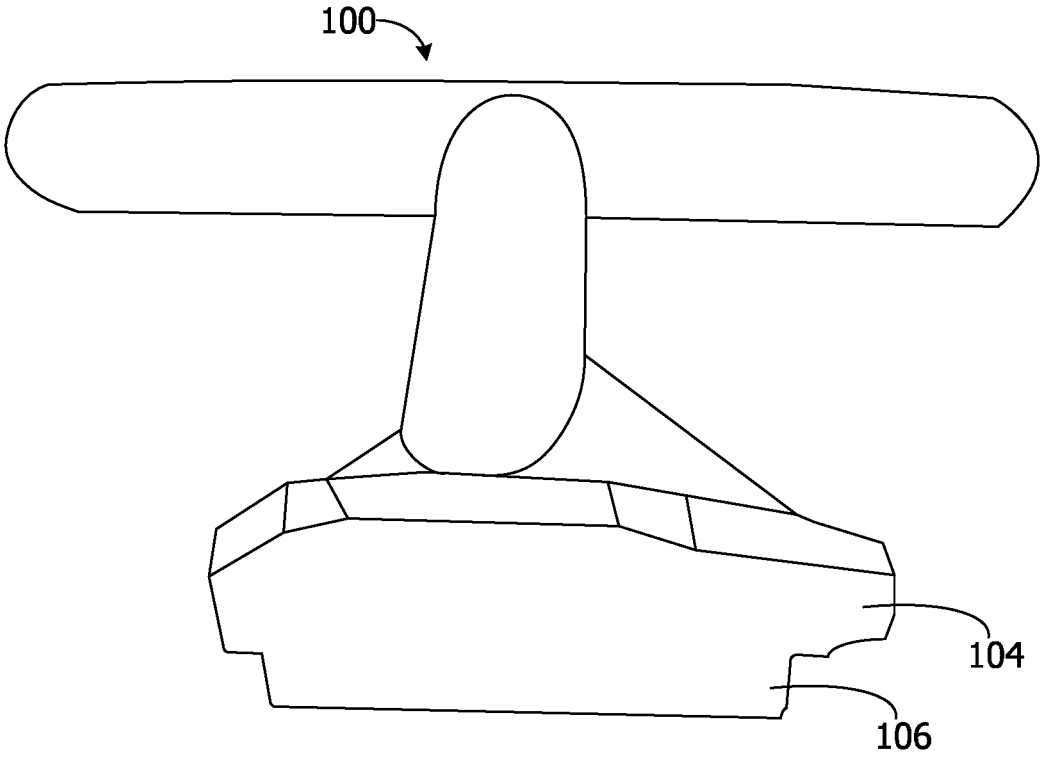
FIG. 9 is an exemplary block diagram illustrating a view of a bottom of the ESL removal tool.

FIG. 9 is an exemplary block diagram illustrating a view of a bottom of the ESL removal tool 100. In this example, the expansion member 104 and the wedge member 106 footprint are shown. The examples are not limited to the shape or size of the wedge member 106 and expansion member 104 shown here. In other examples, the expansion member and/or wedge member can have a different shape and/or different size suitable to accommodate the dimensions of the shelf channel.

Figure 10:
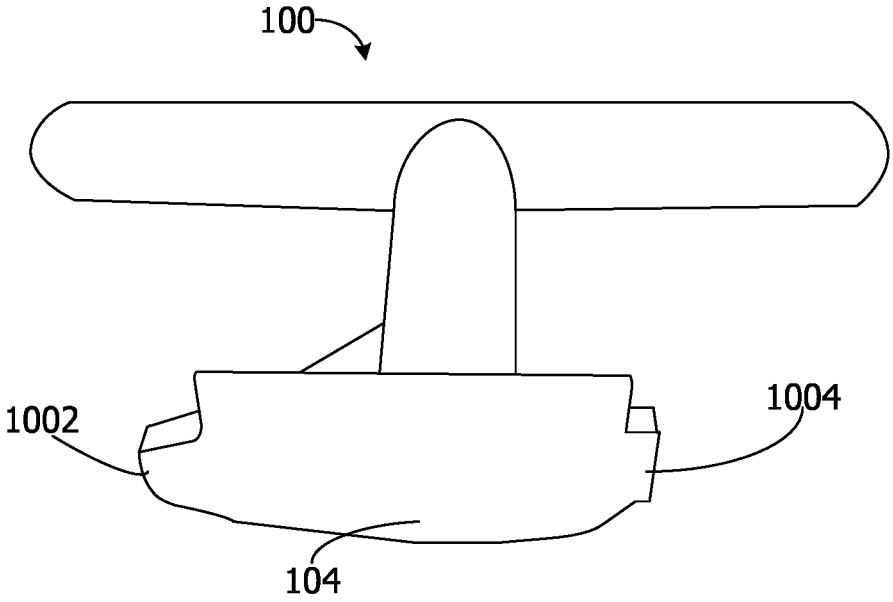
FIG. 10 is an exemplary block diagram illustrating another view of a bottom of the ESL removal tool.

FIG. 10 is an exemplary block diagram illustrating another view of a bottom of the ESL removal tool 100. In some examples, the expansion member 104 includes a substantially rounded or oval-shaped end 1002 and a substantially flat end 1004. The flat end 1004 enables the expansion member to seat against an inside surface of one rail within the channel while the oval-shaped end 1002 pushes against the inside surface of the opposite rail to gently expand the distance between the rails.

Figure 11:
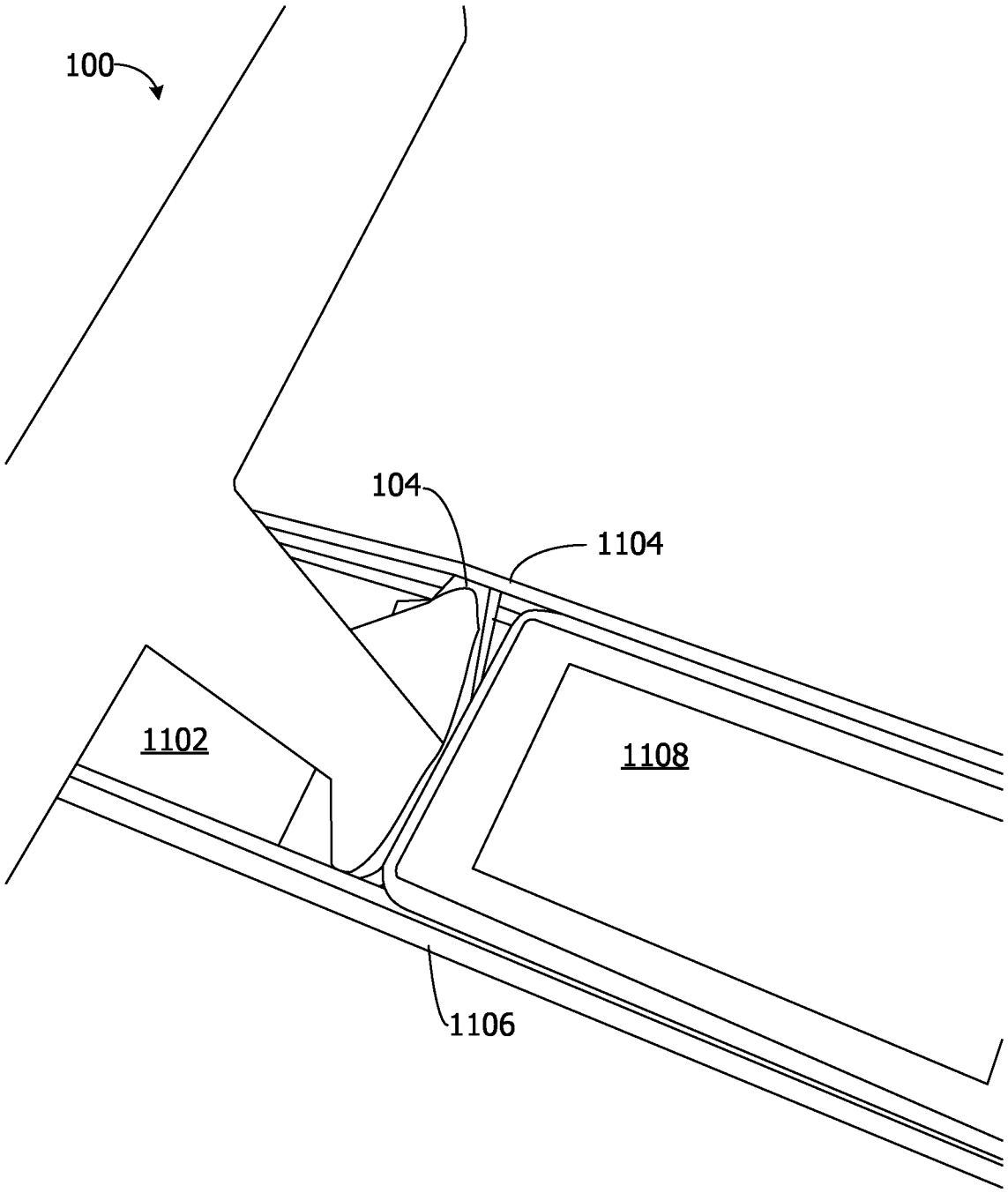
FIG. 11 is an exemplary block diagram illustrating an expansion member on an ESL removal tool.

FIG. 11 is an exemplary block diagram illustrating an expansion member 104 on an ESL removal tool 100. In this non-limiting example, the expansion member is placed inside the channel 1102 between the set of two rails. One side of the expansion member seats against a first rail 1104 and the opposite side of the expansion member pushes against the opposite (parallel) second rail 1106 to increase the distance between the pair of rails. As the rails are pushed apart by the tool, the ESL 1108 is freed from the channel 1102.

Figure 12:
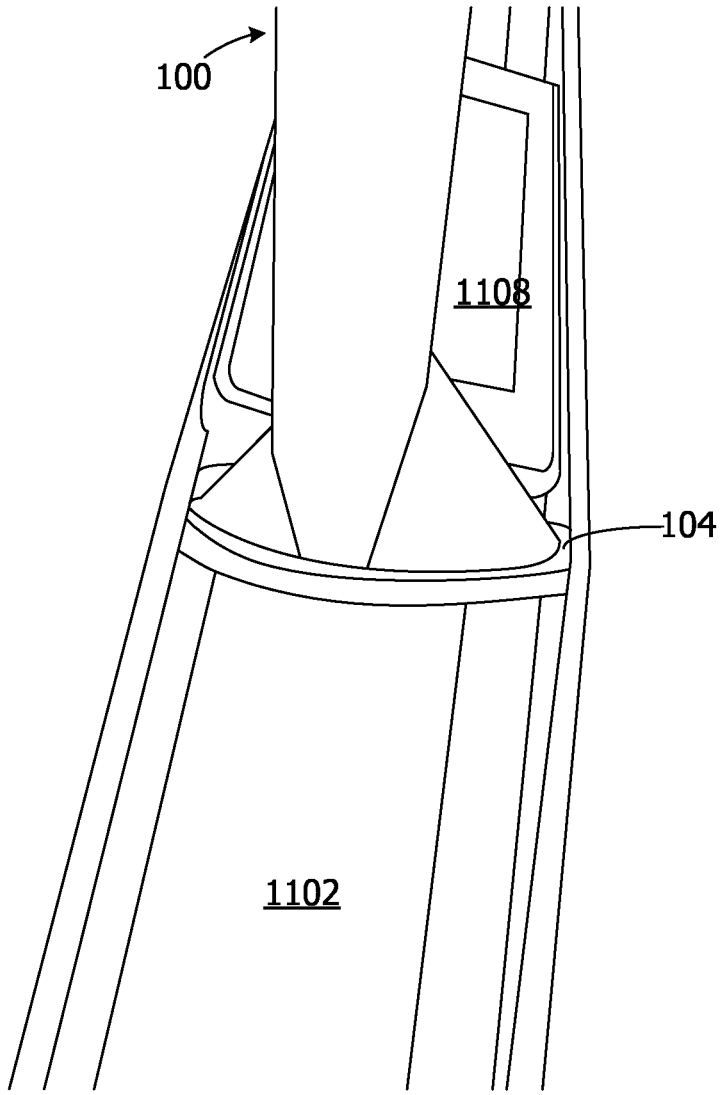
FIG. 12 is an exemplary block diagram illustrating an expansion member in a shelf channel.

FIG. 12 is an exemplary block diagram illustrating an expansion member 104 in a shelf channel 1102. In this example, the expansion member 104 is shown pushing against an interior surface of one of the rails to enable removal of the ESL 1108.

Figure 13:
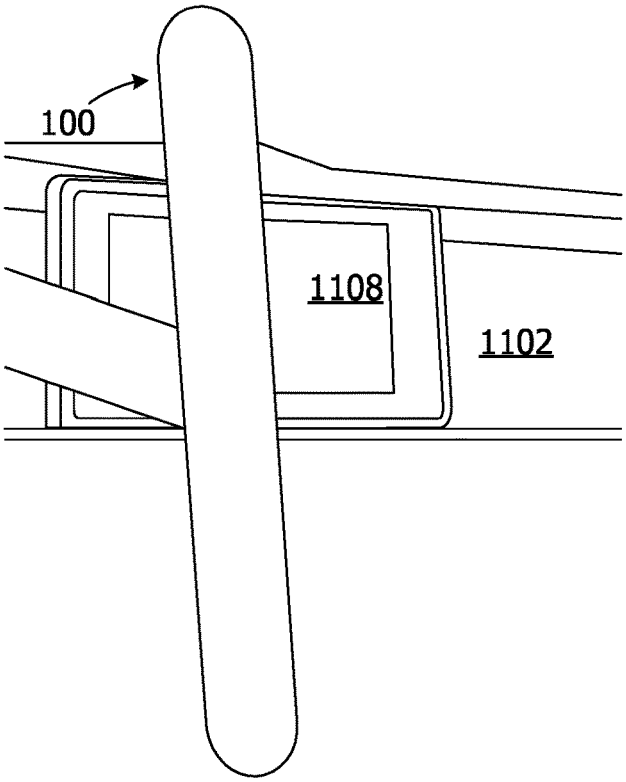
FIG. 13 is an exemplary block diagram illustrating an expansion member expanding rails for ESL removal.

FIG. 13 is an exemplary block diagram illustrating an expansion member 104 expanding rails for ESL 1108 removal from a channel 1102. In this example, the ESL 1108 is freed from between the rails as the tool pushes the rails farther a predetermined distance farther apart.

Figure 14:
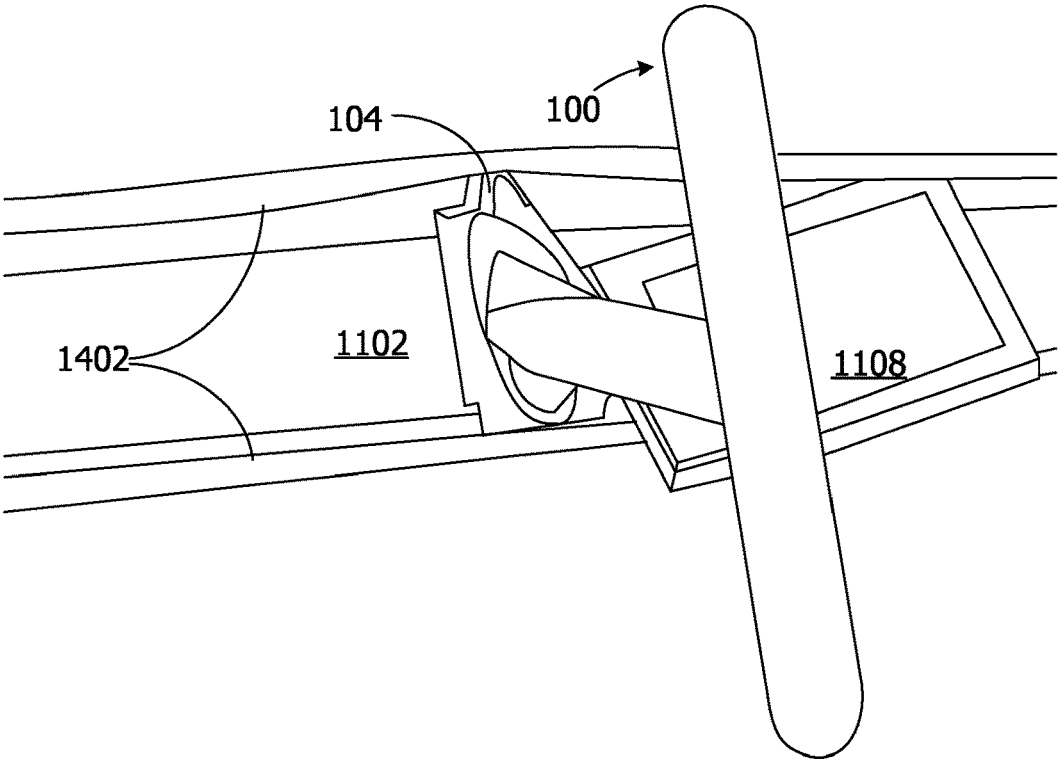
FIG. 14 is an exemplary block diagram illustrating the ESL removal tool expanding rails on a shelf for ESL removal.

FIG. 14 is an exemplary block diagram illustrating the ESL removal tool 100 expanding rails on a shelf for ESL 1108 removal. In some examples, the expansion member 104 seats inside the channel 1102. When the tool is turned a quarter turn in one direction, the tool pushes against one or more rails in a set of rails 1402. Each rail in the set of rails includes a lip which overlaps across a portion of the ESL 1108 to secure the ESL inside the channel. The tool pushes the set of rails slightly apart to permit removal of the ESL from the channel.

Figure 15:
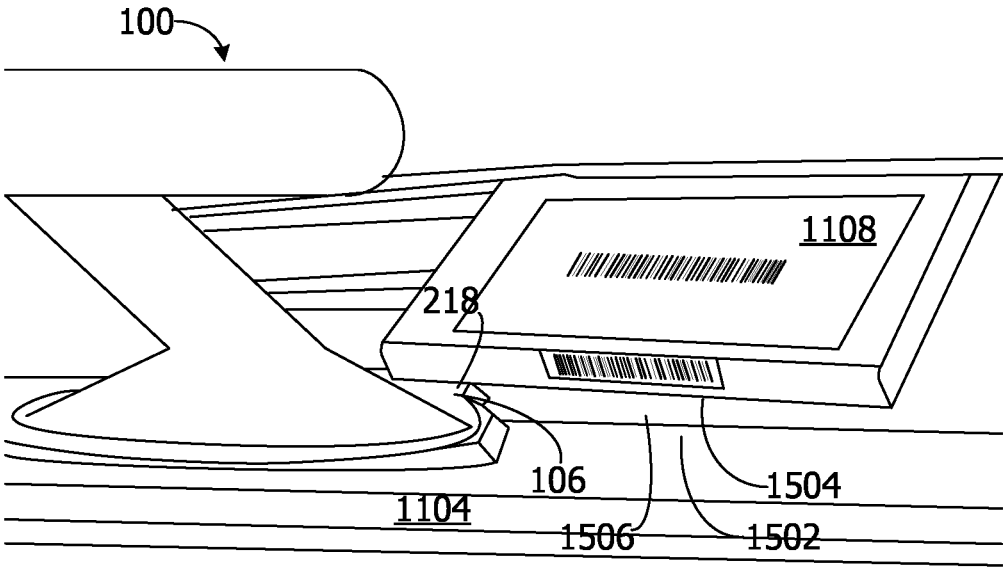
FIG. 15 is an exemplary block diagram illustrating a wedge member on an ESL removal tool.

FIG. 15 is an exemplary block diagram illustrating a wedge member 106 on an ESL removal tool 100. The tapered edge 218 of the wedge member 106 fits within a space between the outside edge 1502 and underside edge 1504 of the ESL 1108. As the tool is levered up or down, the wedge member 106 pushes or pulls the ESL 1108 out of the channel and free of the lip 1506 of the rail 1104.

Figure 16:
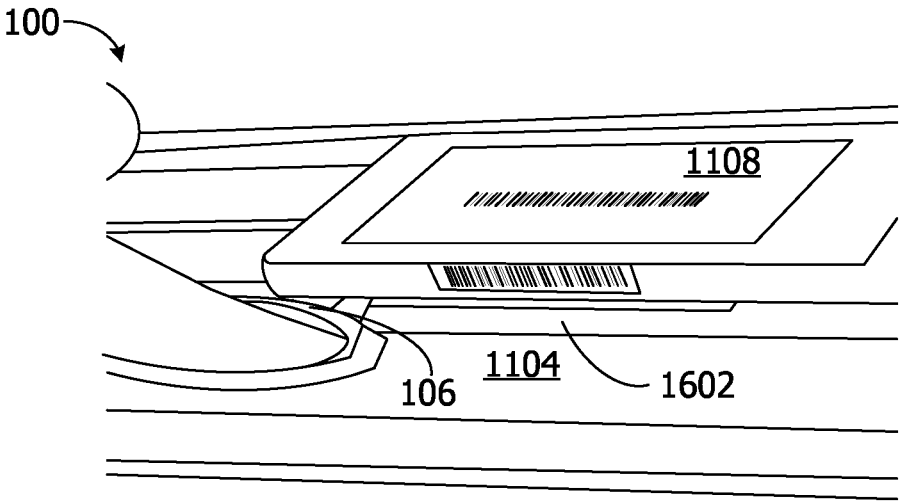
FIG. 16 is an exemplary block diagram illustrating a wedge member on an ESL tool removing an ESL.

FIG. 16 is an exemplary block diagram illustrating a wedge member 106 on an ESL removal tool 100 removing an ESL 1108. As the wedge member pulls or pushes the ESL 1108, the distance 1602 between the edge of the ESL 1108 and the rail 1104 is increased until the ESL is freed from between the pair of rails.

Figure 17:
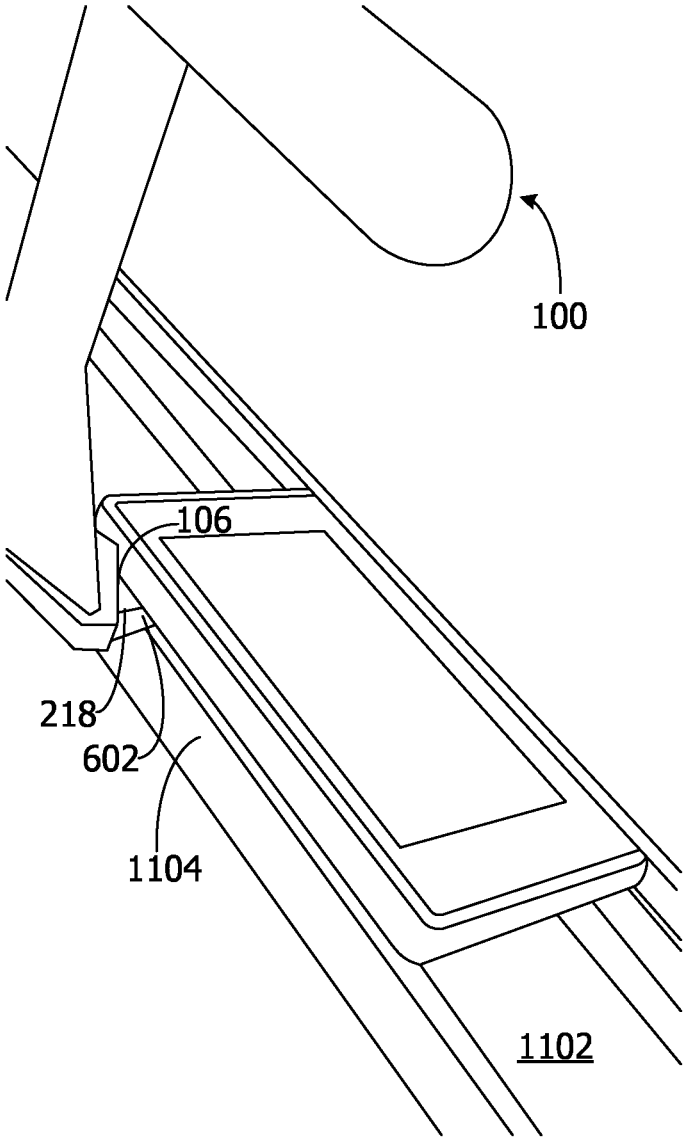
FIG. 17 is an exemplary block diagram illustrating the ESL removal tool removing an ESL from a shelf channel.

FIG. 17 is an exemplary block diagram illustrating the ESL removal tool 100 removing an ESL 1108 from a shelf channel 1102. The thinnest end 602 of the tapering edge 218 of the wedge member 106 fits between the ESL 1108 and the rail 1104.

Figure 18:
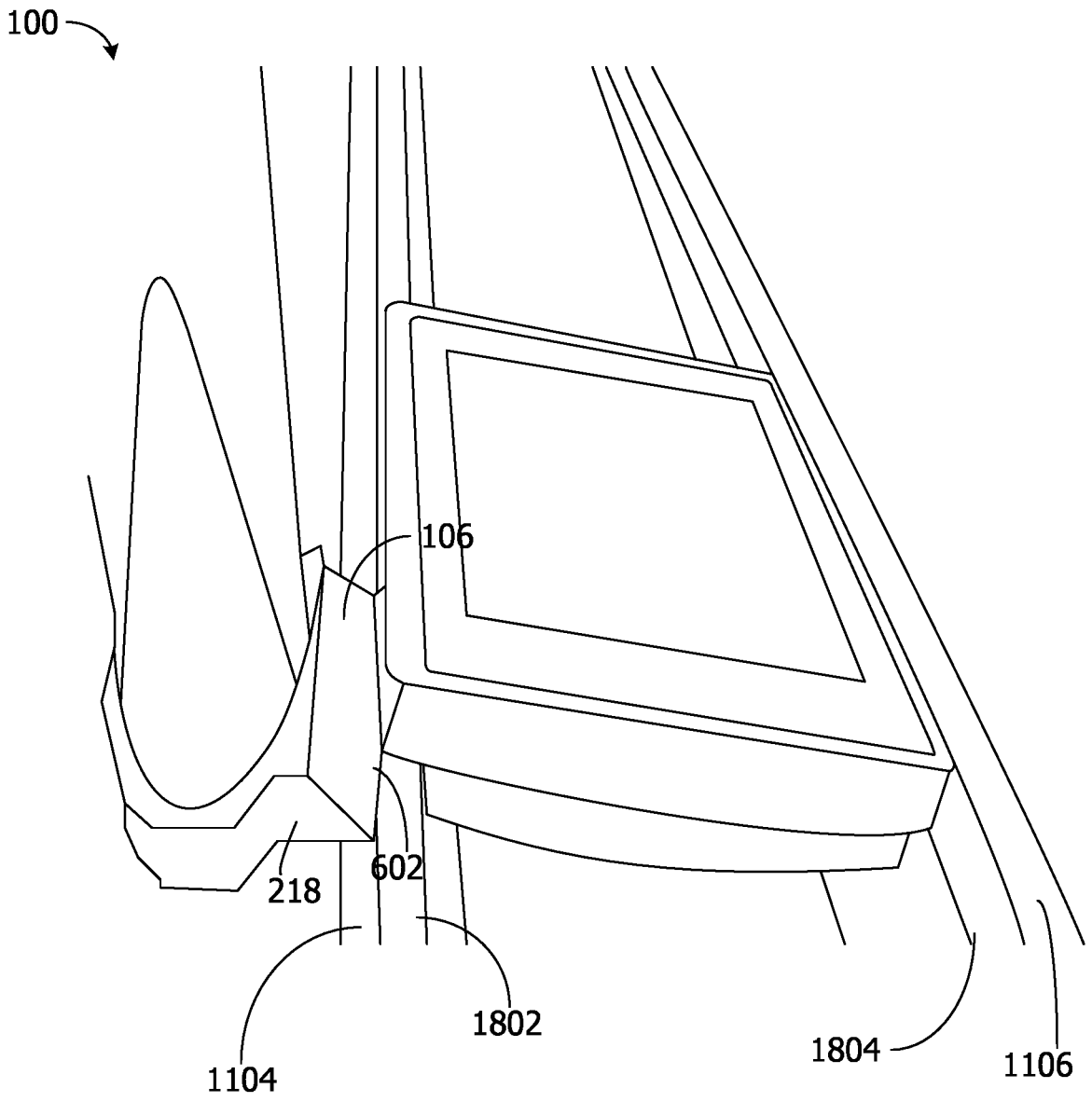
FIG. 18 is an exemplary block diagram illustrating ESL removal tool including a wedge member for removing an ESL from a shelf channel.

FIG. 18 is an exemplary block diagram illustrating ESL removal tool 100 including a wedge member 106 for removing an ESL 1108 from a shelf channel 1102. The tool in this example has freed one side of the ESL 1108 from beneath the lip 1802 of the rail 1104. In other words, one side of the ESL is no longer seated beneath the lip of the rail. The other side of the ESL 1108 in this example remains beneath the lip 1804 of the opposite rail 1106.

Figure 19:
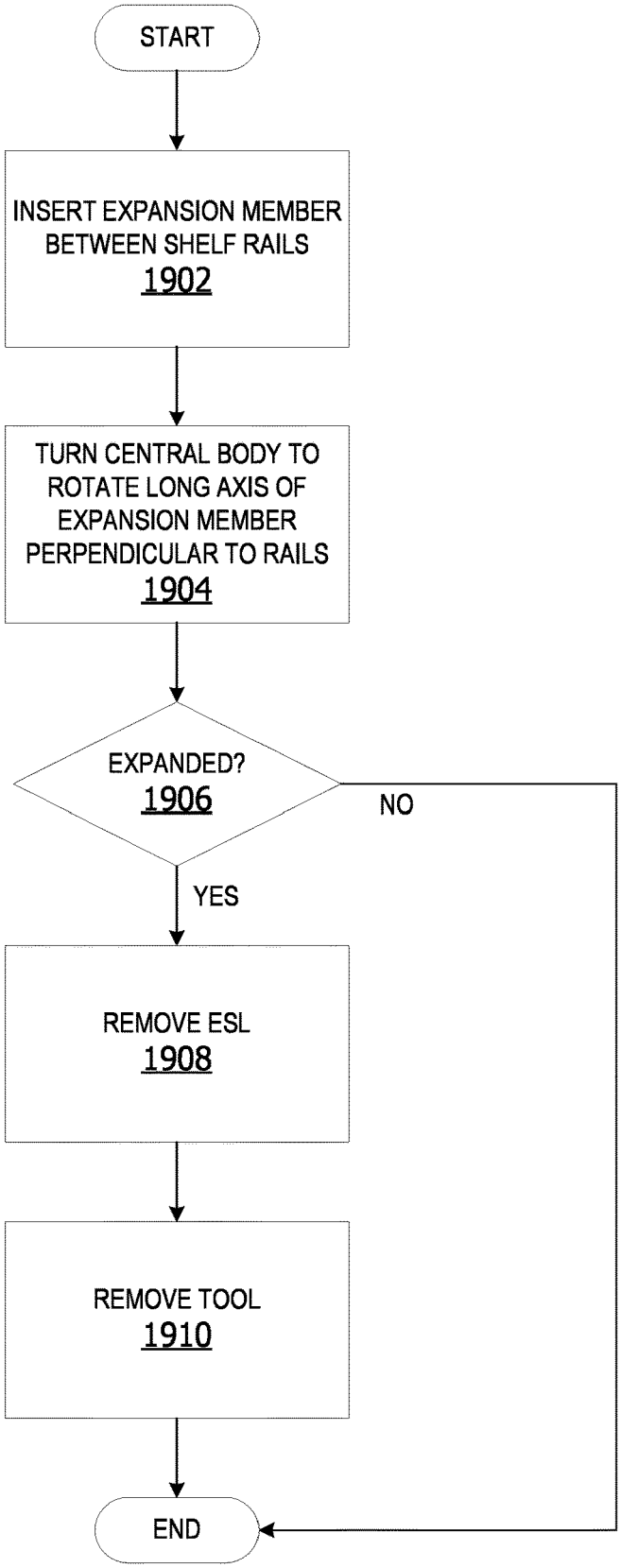
FIG. 19 is an exemplary flow chart illustrating operation of the ESL removal tool including an expansion member for removing ESLs from shelves.

FIG. 19 is an exemplary flow chart illustrating operation of the ESL removal tool including an expansion member for removing ESLs from shelves. The process begins by inserting the expansion member between the shelf rails at 1902. The central body of the tool is turned to rotate the long axis of the expansion member perpendicular to the rails at 1904. If the rails are expanded at 1906, the ESL can be removed at 1908. The tool is removed at 1910. The process terminates thereafter.

Figure 20:
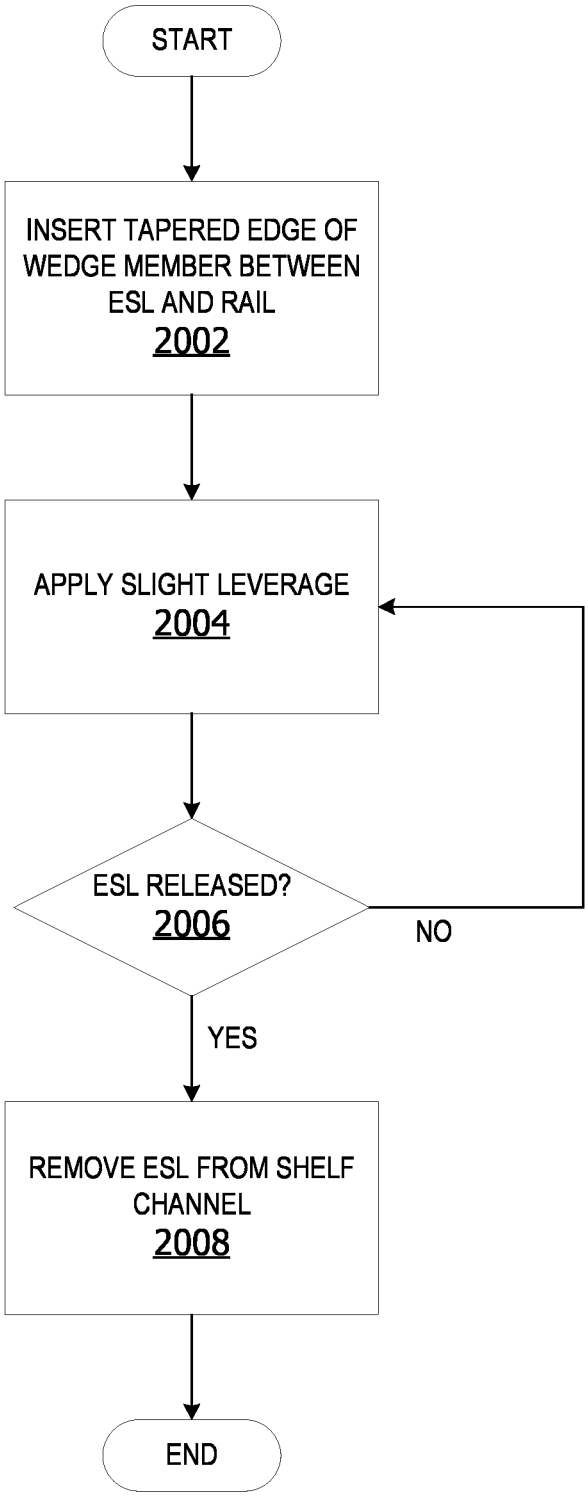
FIG. 20 is an exemplary flow chart illustrating operation of the ESL removal tool including a wedge member for removing ESLs from shelves.

FIG. 20 is an exemplary flow chart illustrating operation of the ESL removal tool including a wedge member for removing ESLs from shelves. The process begins by inserting the tapered edge of the wedge member between the ESL and the lip of the rail at 2002. Gentle force is applied up or down at 2004. A determination is made whether a side of the ESL is released from the rail. If the ESL is released at 2006, the ESL can be removed from the shelf channel at 2008. The process terminates thereafter.

Additional Examples

In some examples, the ESL removal tool has a main body with a wedge member and/or an expander member without a handle. In other examples, the ESL removal tool includes the optional handle. The handle can be a "D" shaped handle to accommodate a thumb, a finger or other portion of the user's hand within the aperture inside the "D" shaped handle. In still other examples, the handle can be a circular or round handle. In still other examples, the handle can be an "L" shaped or "T" shaped handle, or any other shape providing a gripping member for the user to securely hold or grip the tool.

The ESL removal tool assists users in the removal of ESL's from modular display shelves. Although the ESL's twist to lock onto the shelf lip by hand, removing these can be quite difficult or even painful if a number of devices are to be removed in a short time. The tool facilitates removal of the ESL's. Having both an oval shaped and wedge-shaped effector, the tool is designed for both left- and right-dominant users. The tool can be used to spread the rails farther apart to facilitate removal of the tag and/or wedge the ESL out of the shelf channel.

While the aspects of the disclosure have been described in terms of various examples with their associated operations, a person skilled in the art would appreciate that a combination of operations from any number of different examples is also within scope of the aspects of the disclosure.

When introducing elements of aspects of the disclosure or the examples thereof, the articles "a," "an," "the," and "said" are intended to mean that there are one or more of the elements. The terms "comprising," "including," and "having" are intended to be inclusive and mean that there can be additional elements other than the listed elements. The term "exemplary" is intended to mean "an example of." The phrase "one or more of the following: A, B, and C" means "at least one of A and/or at least one of B and/or at least one of C."

Having described aspects of the disclosure in detail, it will be apparent that modifications and variations are possible without departing from the scope of aspects of the disclosure as defined in the appended claims. As various changes could be made in the above constructions, products, and methods without departing from the scope of aspects of the disclosure, it is intended that all matter contained in the above description and shown in the accompanying drawings shall be interpreted as illustrative and not in a limiting sense.

What is claimed is:

1. An apparatus comprising:

a central body;

an expansion member associated with a first end of the central body, the expansion member having a substantially rectangular shape configured to fit between a set of parallel rails that form a shelf channel for securing an electronic shelf label (ESL) and expand a distance between the set of parallel rails to facilitate removal of the ESL from the shelf channel;

a wedge member disposed along a length of the expansion member, the wedge member comprising a tapering edge opposite a side of the wedge member disposed along the length of the expansion member and configured to fit between a portion of the ESL seated within the shelf channel bounded by the set of parallel rails associated with an edge of the shelf and a lip of a rail in the set of parallel rails;

and a gripping member associated with a second end of the central body.

2. The apparatus of claim 1, wherein moving the expansion member via the gripping member upward or downward raises a side edge of the ESL out of the shelf channel.

3. The apparatus of claim 1, further comprising:

a slip resistant covering associated with the gripping member to prevent the gripping member from slipping when held by a user.

4. The apparatus of claim 1, wherein the gripping member provides leverage for movement of the expansion member relative to the shelf channel and the ESL.

5. The apparatus of claim 1, further comprising:

a set of contours associated with the gripping member configured to conform to one or more fingers of a user.

6. The apparatus of claim 1, wherein the wedge member is thicker at the side of the wedge member disposed along the length of the expansion member relative to the tapering edge.

7. The apparatus of claim 1, further comprising:

a cross bar attached to the gripping member forming a T-shaped handle.

8. An electronic shelf label (ESL) removal tool comprising:

a central body;

an expansion member connected to the central body at a first end of the central body, the expansion member having a substantially rectangular shape configured to slide between a parallel set of shelf rails that form a shelf channel, the expansion member configured to increase a distance between the parallel set of shelf rails when disposed between the parallel set of shelf rails;

a wedge member disposed along a length of the expansion member and configured to fit between a portion of an electronic shelf label (ESL) and the shelf channel to release the ESL from between the parallel set of shelf rails; and a gripping member connected to the central body at a second first end of the central body enabling a user to grip the ESL removal tool.

9. The ESL removal tool of claim 8, further comprising:

a set of contours associated with the central body configured to conform to one or more fingers of a user.

10. The ESL removal tool of claim 8, further comprising:

a set of contours associated with the gripping member configured to conform to one or more fingers of a user.

11. The ESL removal tool of claim 8, wherein the gripping member further comprises:

a slip resistant covering configured to prevent the gripping member from slipping when held by a user.

12. The ESL removal tool of claim 8, further comprising:

a cross bar attached to the gripping member forming a T-shaped handle.

13. The ESL removal tool of claim 8, wherein:

the wedge member further comprises a tapering edge opposite a side of the wedge member disposed along the length of the expansion member, the tapering edge configured to slide between the portion of the ESL and the shelf channel.

14. An apparatus comprising:

a central body;

an expansion member disposed at a first end of the central body, the expansion member having a substantially rectangular shape; and a wedge member disposed along a length of the expansion member, the wedge member having a tapering edge opposite a side of the wedge member disposed along the length of the expansion member.

15. The apparatus of claim 14, wherein the expansion member is configured to expand a distance between two parallel rails when turned in a longitudinal orientation relative to the parallel rails.

16. The apparatus of claim 14, further comprising:

a gripping member disposed at a second end of the central body, the gripping member comprising a set of contoured ridges.

* * * * *